United States Patent [19]

Sevastakis

[11] 4,436,143

[45] Mar. 13, 1984

[54] HORIZONTAL CONTINUOUS CASTING APPARATUS

[76] Inventor: Gus Sevastakis, 5645 Angola Rd., Toledo, Ohio 43615

[21] Appl. No.: 500,227

[22] Filed: Jun. 7, 1983

Related U.S. Application Data

[63] Continuation of Ser. No. 255,559, Apr. 20, 1981, abandoned.

[51] Int. Cl.[3] ..... B22D 11/00

[52] U.S. Cl. ..... 164/440; 164/335; 164/420; 164/490

[58] Field of Search ..... 164/419, 439–441, 164/443, 485, 488, 490, 493, 387; 266/236, 242

[56] References Cited

U.S. PATENT DOCUMENTS

| | | | |
|---|---|---|---|
| 2,569,150 | 9/1951 | Brennan | 164/415 |
| 2,787,536 | 12/1946 | Spedding | 164/493 |
| 3,410,331 | 11/1968 | Miller | 164/468 |
| 4,165,865 | 8/1979 | Nowak | 266/242 |
| 4,195,685 | 4/1980 | Sladkoshteev | 164/420 |

FOREIGN PATENT DOCUMENTS

| | | | |
|---|---|---|---|
| 633345 | 5/1963 | Canada | 266/33 |

*Primary Examiner*—Nicholas P. Godici
*Assistant Examiner*—Richard K. Seidel
*Attorney, Agent, or Firm*—Barnes, Kisselle, Raisch, Choate, Whittemore & Hulbert

[57] ABSTRACT

A horizontal continuous casting apparatus comprising a furnace having a bottom wall, side walls and a top wall. A holding block is supported within the furnace and has a vertical opening and a horizontal opening communicating with the vertical opening, the vertical opening extending upwardly. A crucible is mounted within the furnace and has a downwardly extending opening. A vertical adapter provides communication between the opening of the crucible and the vertical opening of the holding block. A side wall of the furnace has a horizontal opening. A horizontal adapter provides communication between the horizontal opening of the holding block and a die associated with the horizontal opening. The die extends externally of the furnace and a cooling device is associated with the die such that molten metal passes downwardly from the crucible through the vertical opening and horizontal opening of the holding block and, in turn, through the die wherein the cooling device functions to progressively solidify the metal as it is removed from the die.

10 Claims, 11 Drawing Figures

HORIZONTAL CONTINUOUS CASTING APPARATUS

This application is a continuation, of application Ser. No. 255,559, filed Apr. 20, 1981, now abandoned.

This invention relates to continuous casting apparatus.

BACKGROUND AND SUMMARY OF THE INVENTION

A common method of producing continuous solid or tubular metal bodies is to draw the molten metal from a crucible through a die which is cooled at a rate and in an intermittent fashion such that the metal is progressively cooled and solidified to form the desired shape. Such methods are commonly known as continuous casting methods and have been performed both vertically and horizontally.

It is common to use horizontal machine to cast ferrous and non ferrous metal products. The most common practice is to use a crucible which receives or melts the metal and a die that fits to the end of the crucible surrounded by a cooler to draw the temperature from the die to form the solid products. An after cooler is often employed to speed up the production or to assist the primary cooler. A silicon carbide crucible is employed to hold the metal during the casting operation and to feed metal to the die continuously. The crucible is placed in a holding furnace to maintain the metal at melting temperature so that the metal may be fed to the die continuously at the proper rate and at the proper temperature. The furnace is fabricated of a steel outside and lined with refractory material to form a wall and a bottom. A cover is placed on top to maintain the heat and hold the temperature from escape during the preheat or during the casting operation. The bottom of the furnace is lined with refractory material to prevent heat loss and hold the temperature and to support the crucible during the operation. A round riser block is placed at the center of the holding furnace to carry the weight of the crucible and the metal during the casting operation. The riser block is made of silicon carbide material, and is cylindrical to hold the weight and align the side furnace opening that accepts the cooler and the die with the side opening in the crucible. The total furnace height varies according to the holding capacity from 4 to 6 feet. A space between the furnace and the crucible is employed to permit circulation of the flame of a burner to maintain the temperature of the metal to be cast. Also a space is formed around the riser block to provide circulation to hold the temperature of crucible and the casting metal.

The crucible employed to hold the casting metal has an L-shaped or goose neck opening to feed metal into the die so that it can be formed and pulled out with a drawn mechanism. The crucicle is made of silicon carbide material or other suitable material which is capable of holding the metal at a temperature over 2000° F. during the casting operation. The crucible is made of two pieces, a main body and a neck. The main body is round and has the goose neck opening for changing the flow of the metal from vertical to a horizontal flow. Such crucibles are very expensive and difficult to make. Delivery is also a problem because most of them are made out of United States. Such apparatus has been found to be expensive both to manufacture and to maintain resulting in higher cost products.

Accordingly, among the objects of the present invention are to provide a novel horizontal continuous casting apparatus which is easier to construct, less costly to construct and maintain, which utilizes conventional crucibles and which can be readily disassembled for maintenance.

In accordance with the invention, the horizontal continuous casting apparatus comprises a furnace having a bottom wall, side walls and a top wall. A casting block is supported within the furnace and has a vertical opening and a horizontal opening which communicate with one another with the vertical opening extending upwardly. A crucible is mounted within the furnace and has a downwardly extending opening. A vertical adapter provides communication between the opening of the crucible and the vertical opening of the holding block. A side wall of the furnace has a horizontal opening and a horizontal adapter provides communication between the horizontal opening of the holding block, and a die is associated with the horizontal opening. The die extends externally of the furnace and a cooling device is associated with the die such that molten metal passes downwardly from the crucible through the verticle opening and horizontal opening of the holding block and, in turn, through the die wherein the cooling device functions to progressively solidify the metal as it is removed from the die.

DESCRIPTION

Figure 1:
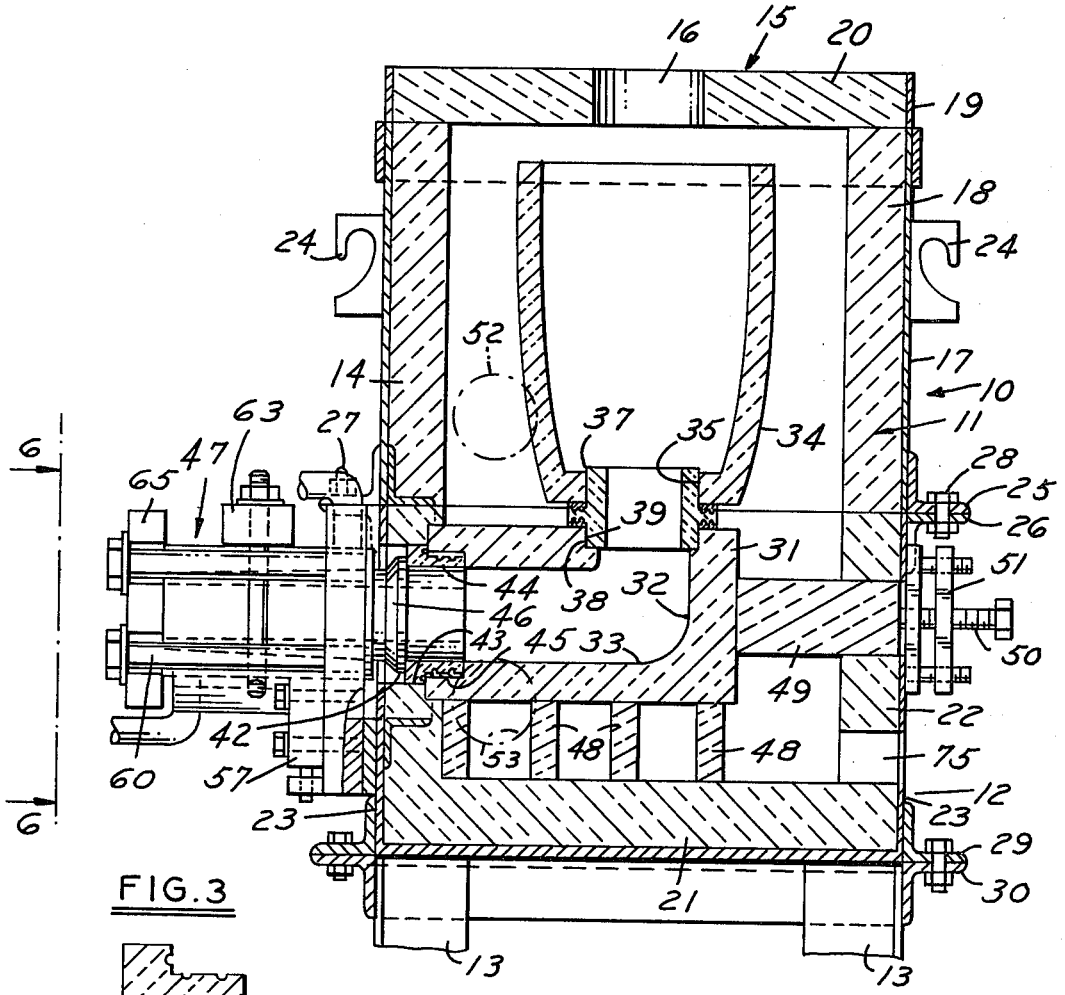
FIG. 1 is a verticl sectional view through a horizontal continuous casting apparatus embodying the invention.
Figure 3:
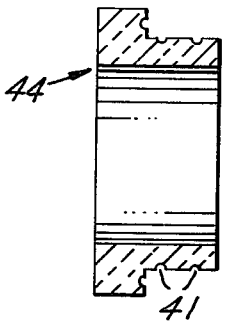
FIG. 3 is a sectional view of a horizontal adapter utilized in the apparatus.
Figure 4:
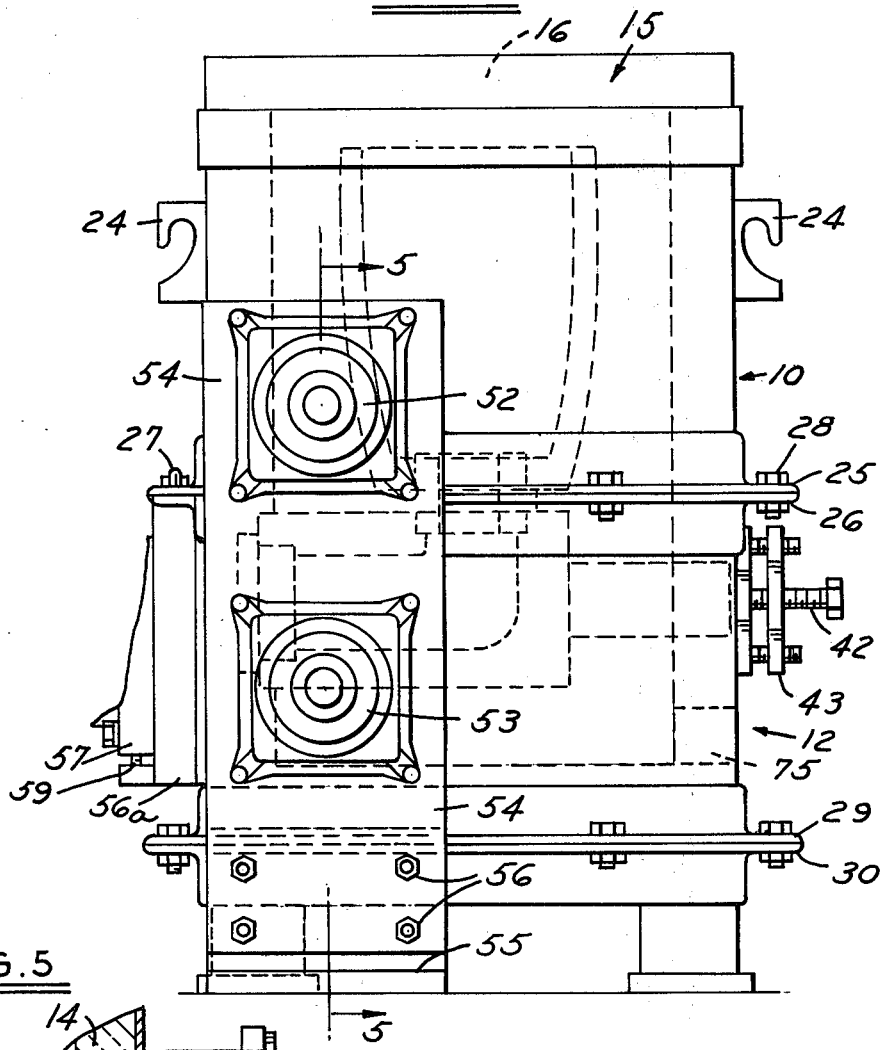
FIG. 4 is a side elevational view taken from the left as viewed in FIG. 1.
Figure 5:
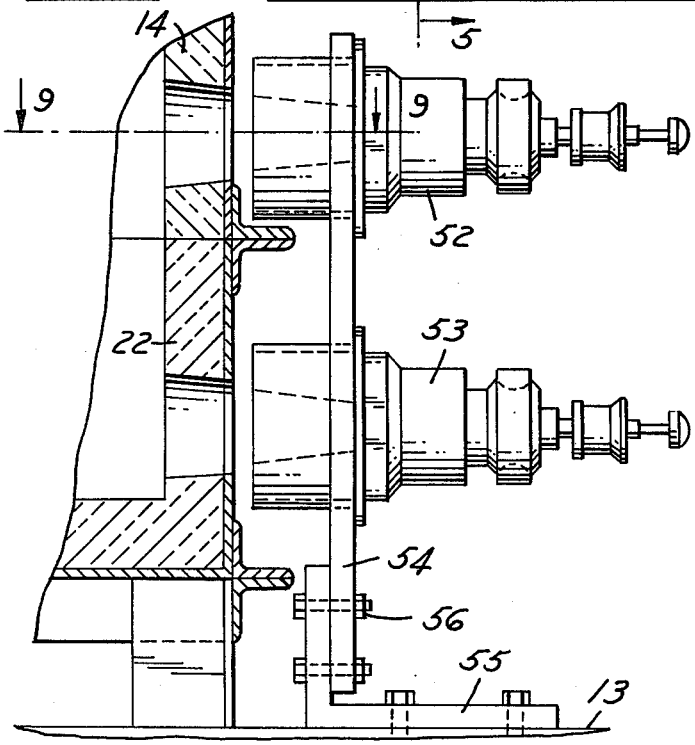
FIG. 5 is a fragmentary sectional view taken along the line 5—5 in FIG. 4.
Figure 6:
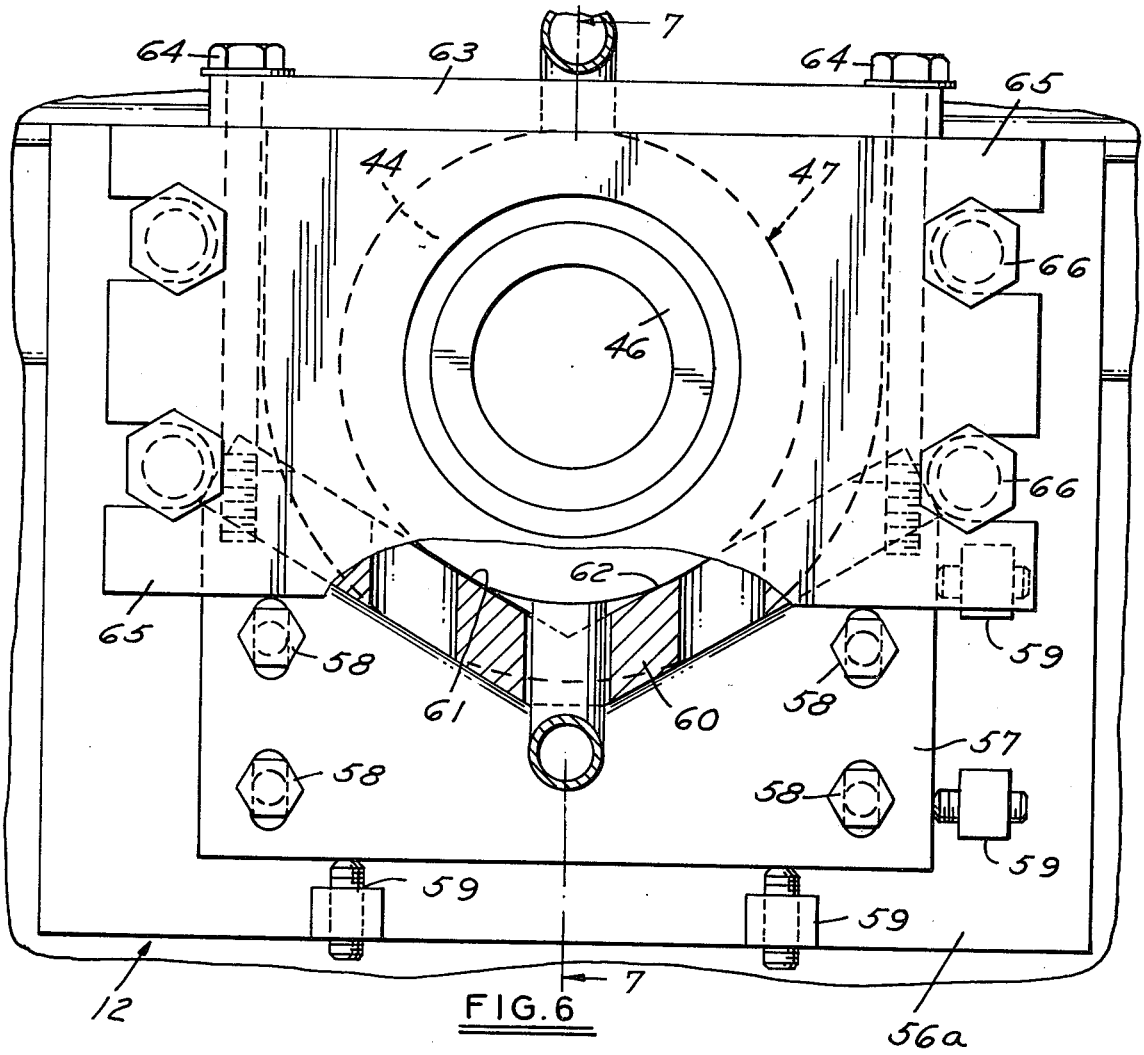
FIG. 6 is a fragmentary view taken along the line 6—6 in FIG. 1.
Figure 7:
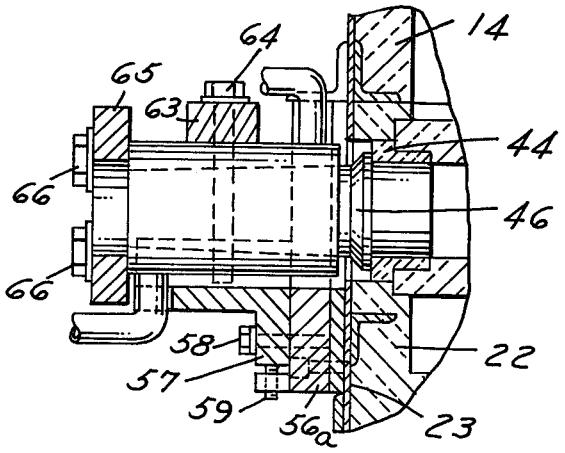
FIG. 7 is a fragmentary sectional view taken along the line 7—7 in FIG. 6.

Referring to FIGS. 1 and 4, the horizontal continuous casting apparatus embodying the invention comprises a furnace 10 that consists of an upper section 11, and a lower section 12 and a base 13. The upper section 11 includes side walls 14 and a removable top wall 15 having an opening 16. The side walls 14 include an exterior metal frame 17 and refractory material 18 and a cover 15 made of refractory material includes a metal frame 19 and refractory block 20.

The bottom section includes a bottom wall 21 and side walls 22 having an exterior metal frame 23 and interior refractory material so that the upper and lower sections 11 and 12 cooperate to form the hollow interior of the furnace 10. The upper and lower sections include cooperating flanges 25, 25 whereby the two sections can be bolted together and hooks 24 so that the upper section can be removed from the lower section for maintenance and service, as presently described.

Guide pins 27 on flange 26 extend through openings in flange 25 to align sections 11, 12 and bolts 28 hold the sections in assembled relation. The lower section 12 and base include flanges 29, 30 that are assembled in a similar fashion. The base 13 is adjustable vertically and horizontally to facilitate alignment of the outlet opening with the draw apparatus.

Figure 2:
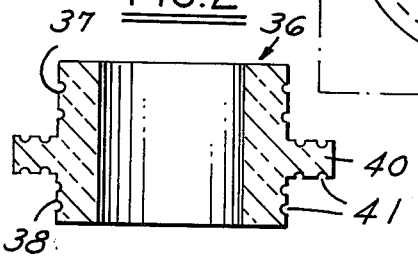
FIG. 2 is a sectional view of a vertical adapter utilized in the apparatus.

The apparatus 10 further includes a casting or holding block 31 that has a vertical opening 32 and a horizontal opening 33. A crucible 34 of a conventional construction including a vertical opening 35 in the bottom wall is mounted on the block 31 by a vertical graphite adapter 36 that has a portion 37 extending into the opening 35 and a portion 38 extending into a shoulder or countersunk portion 39 of the opening 32. As shown in FIG. 2, the adapter 36 further includes a flange 40 that extends radially outwardly between the bottom wall of the crucible 34 and the top wall of the holding block 31. The surfaces of the adapter which contact the opening 35, bottom wall of the crucible, top wall of the block and opening 39 have annular grooves 41 for receiving the sealing material in accordance with conventional refractory and casting practice.

The end of the holding block 31 extends into an opening 43 in the side wall 22 and a horizontal graphite adapter 44 has a portion of reduced cross section extending into a countersunk opening 45 in the block 31. A graphite die 46 having a flange 42 is positioned to receive the molten metal from the horizontal opening 33. The die 46 is surrounded by a cooling device 47 of conventional construction through which liquid is circulated to cool the die so that as the molten metal is drawn through the die, it solidifies into the desired configuration.

The holding block 31 is supported within the furnace by a plurality of support blocks 48 and a pressure block 49 applies pressure to one thereof to hold it against the opposite side wall. The pressure block 49 is adjustably positioned by a bolt 50 threaded through a plate 51 on the frame of the furnace. Bolt 50 engages the pressure block 49 to force the pressure block 49 and, in turn, the holding block 31 to the left as viewed in FIG. 1.

Figure 9:
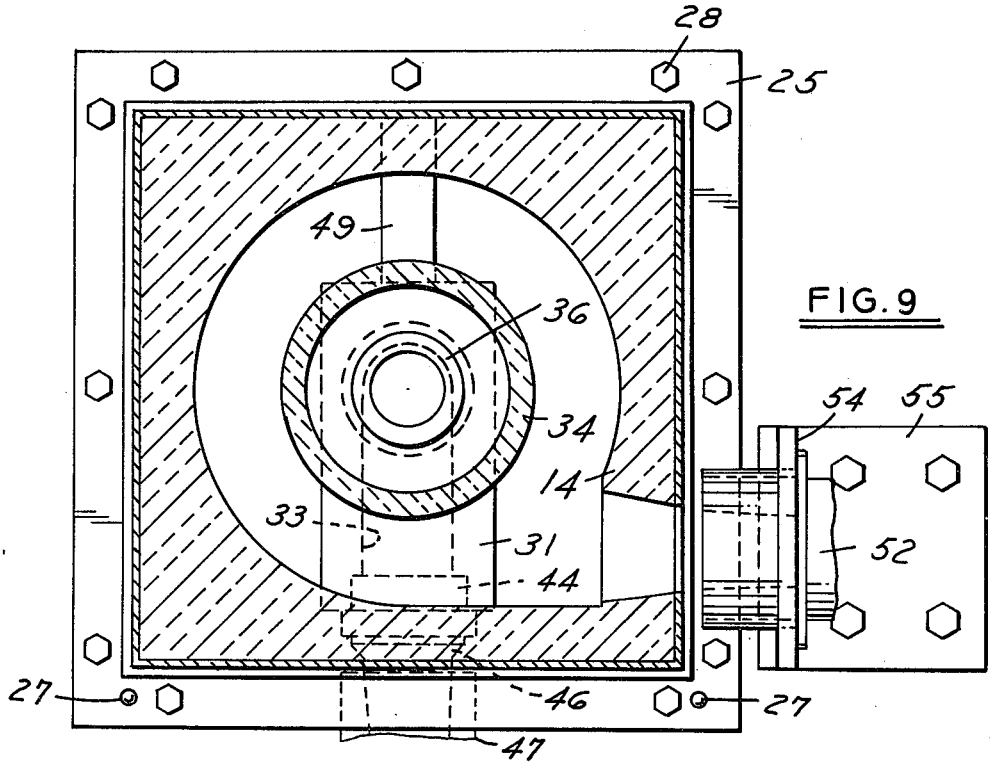
FIG. 9 is a fragmentary sectional view taken along the line 9—9 in FIG. 5.

A first burner 52 is mounted on a vertically adjustable steel plate to heat upper section 10 and a second burner 53 is mounted on the same plate to heat the lower section 12. The burners 52, 53 are preferably supported on the base 13 by a single bracket 54 for convenience and, as shown in FIG. 9, tangentially direct the flames in a circumferential manner about the interior of the furnace, the upper burner 52 maintaining the molten metal in the crucible 34 at the proper temperature and the lower burner 53 functioning to maintain the temperature of the molten metal within the holding block 31.

The bracket 54 is preferably vertically adjustable on a bracket 55 by bolts 56 extending through elongated opening in one of the brackets.

Referring to FIGS. 1, 4, 6 and 7, the graphite die 46 and cooling device 47 are held in position on the frame 23 of the lower furnace section 12 by an arrangement which includes a fixed plate 56*a* fixed on frame 23 as by fastening and an adjustable plate 57 mounted on the fixed plate 56*a* by bolts 58 extending through enlarged openings in the plate 57 and threaded into the fixed plate 56*a*. Adjusting screws 59 extend from the fixed plate 56*a* and engage the bottom and side edges of the movable plate 57 for final adjustment.

The movable plate 57 includes a horizontal portion 60 that extends outwardly and defines inclined surfaces 61, 62 (FIG. 6) which are engaged by the periphery of the cooling device 47, to hold the cooling device 47 and, in turn, the die 46 aligned with the opening in adapter 44. A top bar 63 engages the top of the cooling device 47 and bolts 64 extend through the top bar 63 into the portion 60. A vertical holding plate 65 engages the end of cooling device 47 and horizontal bolts 66 extend through holding plate 65 and are threaded into fixed plate 56*a*.

Figure 10:
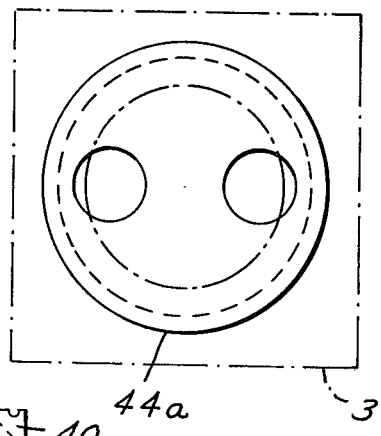
FIG. 10 is an end view of a modified form of horizontal adapter.
Figure 11:
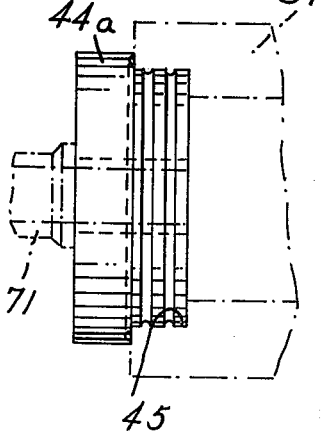
FIG. 11 is a side elevational view of the same.
Figure 8:
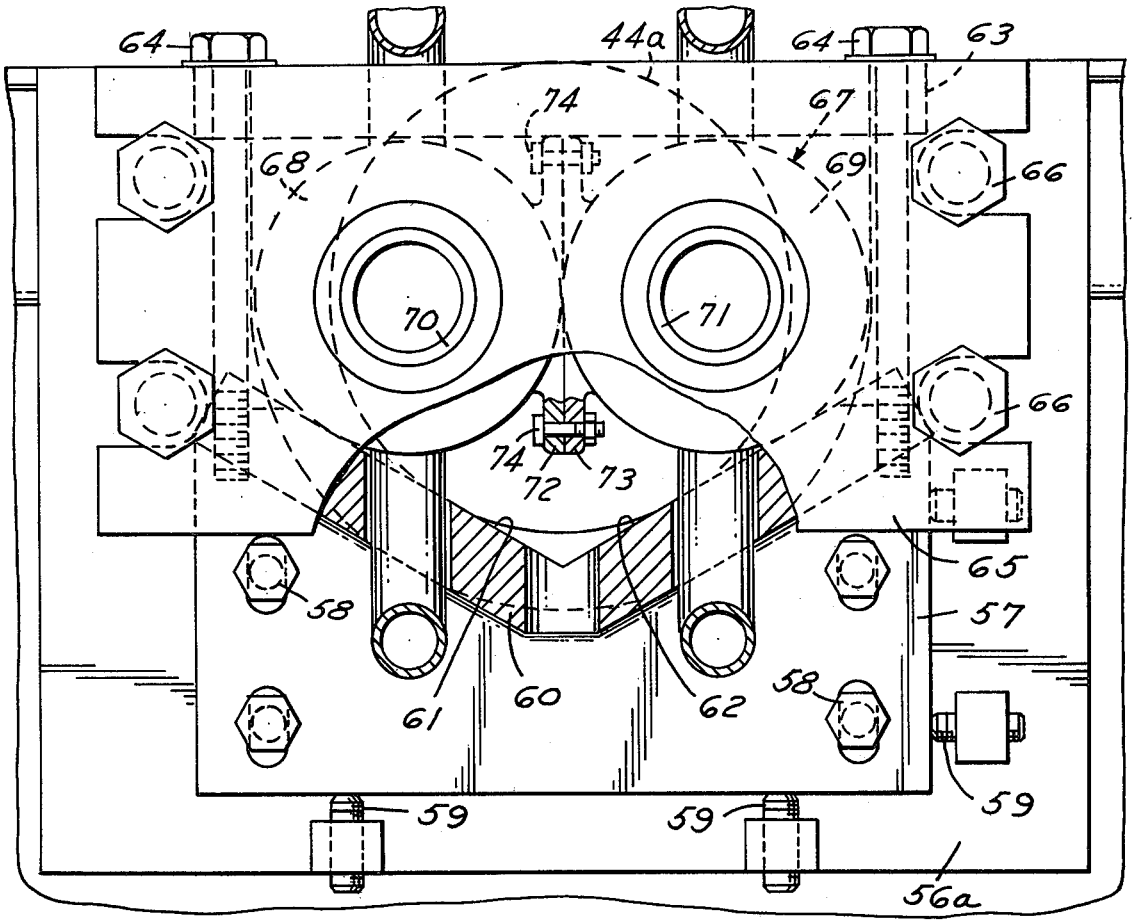
FIG. 8 is a fragmentary view similar to FIG. 4 of a modified form of the invention.

Referring to FIGS. 8, 10 and 11 where two bars are to be formed simultaneously, an identical adapter 44*a* is utilized having two openings.

A double cooling assembly 67 is utilized which has two cooling devices 68, 69 in side by side relation, each of which supports graphite dies 70, 71.

The cooling devices 68, 69 are clamped together by complementary flanges 72, 73 through which bolts 74 extend and the peripheries of the cooling devices engage the inclined surfaces 61, 62 so that the openings in the dies 70, 71 communicate with the opening in the adapter 44*a*.

In a typical installation, the furnace 10 is about 36" tall. The base 13 of the furnace 10 is adjustable up and down and left to right to adjust the height of the center line of the metal outlet. The furnace has a bottom to prevent heat loss from the bottom portion and also to support the holding clock 31. The holding block 31 is made of castable material, is square and the L-shaped opening including the vertical inlet opening 32 and horizontal outlet opening 33 making it possible to use crucibles which are conventionally used for vertical continuous casting and in foundries. Such crucibles are low in cost and readily available. A typical crucible is made of silicon carbide and holds up to 400 pounds or more of copper alloys.

In a typical installation, the openings 32, 33 are approximately one-half of the square dimension of block 31, e.g., for a 9" square block, the hole would be 4.5" diameter. The thickness of the castable material must be strong enough to hold the hydrostatic pressure of the liquid metal and withstand the heat during the casting operation.

In assembly, the lower section 12 is first assembled on the base or at another location with the cooling assembly, die, holding block, pressure block, adapter, and the crucible. The section 12 is then lowered down around the crucible to provide a space between the crucible and the furnace wall so that the flame from the burners surround the crucible for better heat transfer to the metal.

As described above, the sections 11, 12 of the furnace include guided pins to maintain alignment and bolts hold the sections together to form a tight fit between the flanges. A strip of asbestos or other suitable material is placed around the flanges to seal any heat loss from the burners and to protect the steel casting. The base of the furnace is secured to the floor with bolts. The sections 11, 12, and top 15 have hooks to facilitate removal and replacement. Lower section 12 has an opening 75 at the bottom of a side wall thereof for discharging any metal spilled from the furnace.

By having separable sections, the upper or lower section can be replaced by another section and the section which has been removed can be permitted to cool for repairs. As a result, the production downtime of the casting apparatus is minimized. In addition, the lower section which is to replace another lower section can be preheated so that the downtime is further minimized.

In use, the molten metal passes downwardly from the crucible through the opening in the holding block through the die where it is progressively cooled and solidified and removed by a draw mechanism functioning in accordance with conventional practice.

I claim:

1. A horizontal continuous casting apparatus comprising a furnace having a bottom wall, side walls and a top wall, a holding block supported within said furnace and having a vertical opening and a horizontal opening communicating with the vertical opening, the vertical opening extending upwardly, a crucible mounted within said furnace and having a downwardly extending opening, means for providing communication between the opening of the crucible and the vertical opening of said block, a side wall of said furnace having a horizontal opening, a die associated with said horizontal opening in the side wall and extending externally of said furnace, means for providing communication between the horizontal opening of the holding block and said die, and cooling means associated with said die such that molten metal passes downwardly from said crucible through the vertical opening and horizontal opening of said block and, in turn, through said die wherein the cooling means function to progressively solidify the metal as it is removed from the die, a mounting bracket on said furnace defining downwardly and inwardly inclined surfaces engaged by said cooling means to locate and align said die with said opening in said holding block.

2. The horizontal continuous casting apparatus set forth in claim 1 wherein said means providing communication between said horizontal opening in said holding block and said die comprises an adapter interposed between said holding block and said die.

3. A horizontal continuous casting apparatus comprising a furnace, said furnace comprising an upper section and a lower section, the upper section of said furnace comprising side walls and a top wall having an opening, the lower section of said furnace comprising side walls and a bottom wall, a removable block supported within said furnace on said bottom wall of said lower section in spaced relation to said bottom wall and having a vertical opening and a horizontal opening communicating with the vertical opening, a removable vertical adapter mounted on said holding block in association with the vertical opening of the holding block, a removable crucible having a bottom opening and mounted within said furnace and having a downwardly extending opening for providing communication between the opening of the crucible and the vertical opening of said block, a side wall of said lower section of said furnace having a horizontal opening at the lowest point for egress of spilled metal, a removable die mounted on a side wall of said lower section and associated with said horizontal opening of said holding block and extending externally of said furnace, a removable horizontal adapter providing communication between the horizontal opening of the holding block, said die and said horizontal adapter being removable and insertable from the exterior of said side wall of said lower section, and cooling device on the exterior of said side wall of said lower section surrounding said die such that molten metal passes downwardly from said crucible through the vertical opening and horizontal opening of said block and, in turn, through said die wherein the cooling means function to progressively solidify the metal as it is removed from the die, means removably interconnecting said upper and lower section such that the upper section may be removed from said lower section, said upper section and said lower section being joined in a plane adjacent the bottom wall of the crucible to provide access to said crucible, holding block, vertical adapter and horizontal adapter when the upper section is removed.

4. The horizontal continuous casting apparatus set forth in claim 3 wherein said vertical adapter has a portion thereof extending into the bottom opening of the crucible and a portion thereof extending into the vertical opening of said holding block, said adapter having an opening therethrough whereby the molten metal may flow from the bottom opening of the crucible to the vertical opening of the holding block.

5. The horizontal continuous casting apparatus set forth in claim 3 wherein said horizontal adapter has a portion extending into the horizontal opening of said holding block and another portion engaging said die, said adapter having an opening therethrough communicating with the horizontal opening of the holding block.

6. The horizontal continuous casting apparatus set forth in claim 5 wherein said horizontal adapter has a plurality of openings communicating with the horizontal opening of the holding block, a plurality of dies, each said die being associated with a separate horizontal opening in said horizontal adapter, and individual cooling mean associated with each said side.

7. The horizontal continuous casting apparatus set forth in claim 3 including means mounting said cooling means on said furnace.

8. The horizontal continuous casting apparatus set forth in claim 3 including first burner means mounted externally and associated with the upper section of said furnace and second burner means mounted externally and associated with the lower section of said furnace.

9. The horizontal continuous casting apparatus set forth in claim 8 wherein each said burner means is associated to produce a circumferential movement of said flame of said burner about the interior of said furnace.

10. The horizontal continuous casting apparatus set forth in claim 3 including a removable pressure block associated with said holding block and diametrically opposed to said horizontal adapter and mechanical means on the exterior of said furnace adapted to supply pressure to said pressure block and, in turn, hold said holding block in position against the side wall of said furnace.

* * * * *